United States Patent [19]

Krenkel

[11] 3,930,614

[45] Jan. 6, 1976

[54] DEVICE FOR SPRAYING A TRAVELING PAPER WEB OR THE LIKE

[75] Inventor: Bernhard Krenkel, Heidenheim, Germany

[73] Assignee: J. M. Voith GmbH, Heidenheim, Germany

[22] Filed: Sept. 9, 1974

[21] Appl. No.: 504,140

[30] Foreign Application Priority Data

Sept. 14, 1973 Germany ..... 2346371

[52] U.S. Cl. ..... 239/15

[51] Int. Cl.[2] ..... B05B 5/00; F23D 11/28

[58] Field of Search ..... 239/3, 15, 550

[56] References Cited

UNITED STATES PATENTS

| | | | |
|---|---|---|---|
| 2,729,191 | 1/1956 | Ransburg | 239/15 |
| 2,733,171 | 1/1956 | Ransburg | 239/15 |
| 3,323,934 | 6/1967 | Point | 239/15 |
| 3,402,697 | 9/1968 | Kock | 239/15 |
| 3,476,082 | 11/1969 | Cowles | 239/15 |
| 3,757,491 | 9/1973 | Gourdine | 239/15 |

*Primary Examiner*—Lloyd L. King

*Attorney, Agent, or Firm*—Herbert L. Lerner

[57] ABSTRACT

Device for spraying a traveling paper web or the like with a liquid under the influence of an electrostatic high voltage includes spray nozzle means for spraying the liquid through a given space and onto the web, high voltage source means, electrode means connected to the high voltage source means and energizable thereby to ionize the space through which the liquid is sprayed, and means for grounding the web and the spray nozzle means.

3 Claims, 4 Drawing Figures

DEVICE FOR SPRAYING A TRAVELING PAPER WEB OR THE LIKE

The invention relates to a device for spraying a traveling paper web or the like with a liquid under the influence of an electrostatic high voltage, with spray nozzles for supplying the liquid, as well as with a high voltage source.

From U.S. Pat. No. 3,625,743, a device of the foregoing type is known wherein the paper web is electrostatically charged while spray nozzles for supplying the medium to be applied are connected to the antipole or opposite pole of the high voltage source. This heretofore known device is advantageously utilizable when the paper web is relatively dry. If medium is to be applied, however, in a damp part of a paper machine, it is not possible to electrostatically charge the paper web because, otherwise, the entire paper machine and also the surroundings would be charged therewith. Also, the charging of spray nozzles heretofore known from U.S. Pat. No. 1,611,787, wherein the entire supply system is subjected to a voltage charge, has been shown to be disadvantageous, because, in a very complex manner, insulation against the surroundings is necessary. Moreover, not only the ground paper web, but also the similarly grounded machine are sprayed.

It is accordingly an object of the invention to provide a device for spraying a paper web that is utilizable both in the damp part and at the beginning of the dry part of a paper machine.

With the foregoing and other objects in view, there is provided, in accordance with the invention, a device for spraying a traveling paper web or the like with a liquid under the influence of an electrostatic high voltage comprising spray nozzle means for spraying the liquid through a given space and onto the web, high voltage source means, electrode means connected to the high voltage source means and energizable thereby to ionize the space through which the liquid is sprayed or with which it comes in contact, and means for grounding the web and the spray nozzle means.

In connection therewith, there occurs a very effective ionization of the liquid particles that are to be applied, which thereby deposit in a very uniform layer on the web, without charging of the spray device or the web so that damaging effects of the electrostatic high voltage are excluded therefrom.

In accordance with another feature of the invention, the spray nozzle means comprise a plurality of spray nozzles disposed on both sides of a path through which the paper web travels so as to spray the web on both sides thereof, the high voltage source means comprising a first high voltage source producing a positive high voltage potential and a second high voltage source producing a negative high voltage potential, the electrode means comprising electrodes on both sides of the travel path of the web, the electrodes on one side thereof being connected to the first high voltage source, and the electrodes on the other side thereof being connected to the second high voltage source. Both sides of the paper web can thereby be sprayed simultaneously, without the media being applied having any mutally disadvantageous influences.

In accordance with yet another feature of the invention, the electrode means are in the form of a grid surrounding the spray nozzle means, the grid being connected to the high voltage source means.

Through this construction of the electrode, the air surrounding the spray nozzles and, accordingly, the medium to be applied, which issues from the spray nozzles, ionize very uniformly so that also an extremely uniformly distributed deposition is produced on the paper web.

Although the invention is illustrated and described herein as device for spraying a traveling paper web or the like, it is nevertheless not intended to be limited to the details shown since various modification and structural changes may be made therein without departing from the spirit of the invention and within the scope and range of equivalents of the claims.

The construction and method of operation of the invention, however, together with additional objects and advantages thereof will be best understood from the following description when read in connection with the accompanying drawings, in which.

Figure 3A:
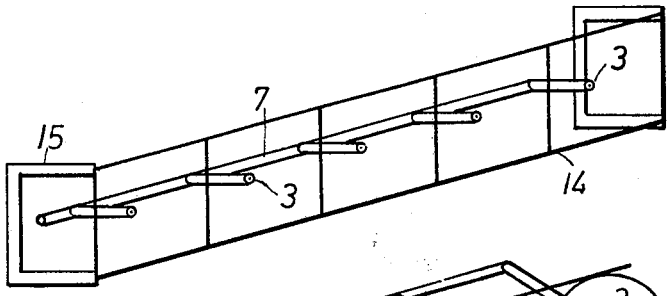
Figure 3B:
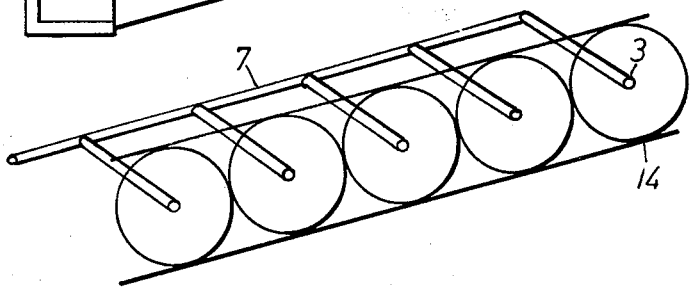

FIGS. 3*a* and 3*b* are diagrammatic perspective views of two different embodiments of one of the electrdes of the invention which is constructed in the form of a grid.

Figure 1:
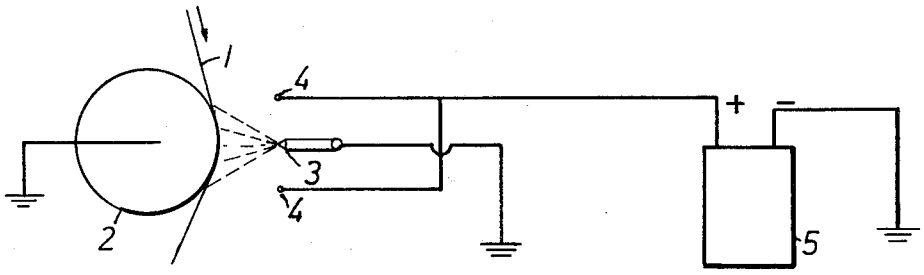
FIG. 1 is a diagrammatic view of the device for spraying a traveling paper web or the like, according to the invention, showing a paper web guided about a roller and having a row of spray nozzles associated therewith, and including electrodes disposed in the intermediate space between the spray nozzles and the paper web, for producing an electrostatic high voltage field.

Referring now to the drawing and first, particularly, to FIG. 1 thereof, there is shown an embodiment of the device for spraying a traveling paper web or the like, according to the invention, wherein a paper web 1 is guided around a roller 2. In the region at which the web 1 bends about the roller 2, a row of spray nozzles 3 is disposed, only one of which being visible in the figure because they are all located one behind the other in a direction transverse to the direction of travel of the web 1 or, in other words, in a direction perpendicular to the plane of the drawing in FIG. 1. Rod-shaped electrodes 4 are located above and below the spray nozzles 3 and extend transversely to the web travel direction and are connected to one of the poles of a high voltage source 5. In the embodiment of FIG. 1, it is the positive pole. The negative pole of the high voltage source 5 in the embodiment of FIG. 1 is grounded, and so also are the paper web and the spray nozzles. Through the electrodes 4, the entire space between them, the paper web 1 and the spray nozzles 3 are ionized.

Figure 2:
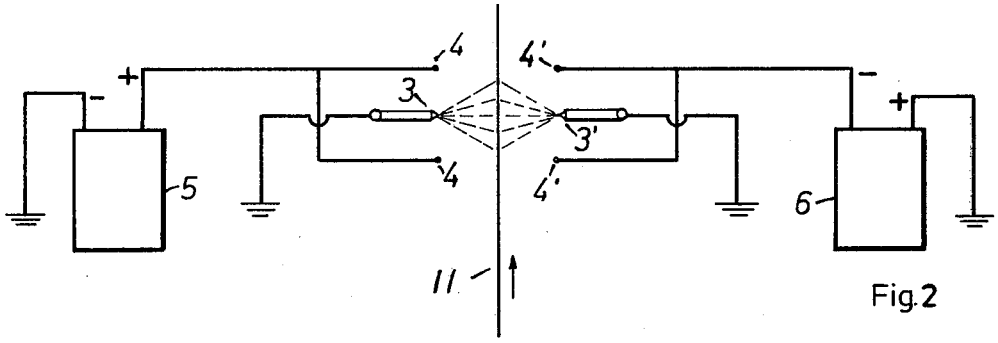
FIG. 2 is a diagrammatic view of another embodiment of the invention wherein the paper web is guided in a plane, and a row of spray nozzles and electrodes are disposed on both sides thereof.

In the embodiment of FIG. 2, on both sides of a straightly traveling paper web 11, that is a web 11 traveling in a plane, a row of spray nozzles 3 and 3', respectively, are disposed, which are located opposite one another and are of substantailly identical construction. Electrodes 4 and 4' of substantially identical construction are disposed above and below the spray nozzles 3 and 3', respectively. The electrodes 4 on the one side of the web 1, are connected to a positive high voltage, and the electrodes 4' on the other side to a negative high voltage, the high voltages originating from different high voltage sources 5 and 6, the free poles of which are respectively grounded. The paper web 11 is necessarily also grounded due to the nonillustrated machine parts that are in contact therewith.

In FIGS. 3*a* and 3*b*, a row of nozzles 3 are shown, which are located on or extend from a common tube 7 disposed transversely to the web travel direction and simultaneously serving as means for supplying the medium that is to be applied to the web. As electrodes for the connection of the electrostatic high voltage, there is provided in FIG. 3*a* a grid 14 formed primarily of rods extending transversely to the web travel direction and mounted in an insulator 15 and which, in front of and behind each spray nozzle 3, are connected by transverse rods to one another, so that the spray nozzles are connected on all sides by electrode rods. In FIG. 3*b*, the electrode grid annularly surrounds the individual nozzles 3. Consequently, a uniform electrostatic high voltage field is produced over the entire length of the spray nozzle row which corresponds substantially to the width of the paper web.

I claim:

1. Device for spraying a traveling paper web or the like with a liquid under the influence of an electrostatic high voltage comprising spray nozzle means for spraying the liquid through a given space and onto the web, high voltage source means, electrode means connected to said high voltage source means and energizable thereby to ionize the space through which the liquid is sprayed, and means for grounding the web and said spray nozzle means, said spray nozzle means and said electrodes each being disposed on both sides of a path through which the web travels and each being located opposite one another.

2. Device according to claim 1 wherein said high voltage source means comprise a first high voltage source producing a positive high voltage potential and a second high voltage source producing a negative high voltage potential, said electrode means comprising electrodes on both sides of the travel path of the web, the electrodes on one side thereof being connected to said first high voltage source, and the electrodes on the other side thereof being connected to said second high voltage source.

3. Device according to claim 1 wherein said electrode means are in the form of a grid surrounding said spray nozzle means on all sides.

* * * * *